US011634863B2

(12) United States Patent
Bilodeau et al.

(10) Patent No.: US 11,634,863 B2
(45) Date of Patent: Apr. 25, 2023

(54) METHOD TO PRODUCE COMPOSITE-ENHANCED MARKET PULP AND PAPER

(71) Applicant: University of Maine System Board of Trustees, Orono, ME (US)

(72) Inventors: Michael A. Bilodeau, Orono, ME (US); Mark A. Paradis, Orono, ME (US)

(73) Assignee: University of Maine System Board of Trustees, Orono, ME (US)

( * ) Notice: Subject to any disclaimer, the term of this patent is extended or adjusted under 35 U.S.C. 154(b) by 178 days.

(21) Appl. No.: 16/754,556

(22) PCT Filed: Oct. 11, 2018

(86) PCT No.: PCT/US2018/055381

§ 371 (c)(1),
(2) Date: Apr. 8, 2020

(87) PCT Pub. No.: WO2019/075184

PCT Pub. Date: Apr. 18, 2019

(65) Prior Publication Data

US 2020/0347549 A1 Nov. 5, 2020

Related U.S. Application Data

(60) Provisional application No. 62/571,389, filed on Oct. 12, 2017.

(51) Int. Cl.
*D21C 9/00* (2006.01)
*D21H 17/24* (2006.01)

(52) U.S. Cl.
CPC ..... *D21C 9/005* (2013.01); *D21C 9/007* (2013.01); *D21H 17/24* (2013.01)

(58) Field of Classification Search
CPC ..... D21C 9/005; D21C 9/007; D21C 9/18; D21H 17/24; D21H 11/18; D21H 17/06;
(Continued)

(56) References Cited

U.S. PATENT DOCUMENTS 3,160,552 A 12/1964 Russell et al.
4,643,800 A 2/1987 Maloney et al.
(Continued)

OTHER PUBLICATIONS

The introduction of NFC—Cellulose Lab Nanocellulose Products 2019 contact@celluloselab.com.*
(Continued)

*Primary Examiner* — Jacob T Minskey
*Assistant Examiner* — Matthew M Eslami
(74) *Attorney, Agent, or Firm* — MacMillan, Sobanski & Todd, LLC

(57) ABSTRACT

An improved market pulp and process for making the same by adding a composite material are described. The composite material includes cellulose nanocrystals, cellulose nanofibers, or another high aspect ratio, high surface area cellulose material (or a starch, or both) and a crosslinking compound that crosslinks a portion of the surface hydroxyl groups to form a 3-D matrix. Adding the composite material to market pulp has been shown to improve the strength of twice-dried paper products, made from such an enhanced market pulp. By crosslinking a portion of the surface hydroxyl groups in the market pulp to form a 3-D matrix, a first drying step may be accomplished without loss of benefits afforded when the market pulp is later re-pulped to make a paper product.

15 Claims, 6 Drawing Sheets
(4 of 6 Drawing Sheet(s) Filed in Color)

(58) Field of Classification Search
CPC ..... D21H 21/18; D21H 21/20; D21H 17/28; D21H 17/67; D21H 17/71; D21H 17/74; D21H 17/69; D21H 19/38; C08L 3/02; C08L 2666/54; C09C 1/021; C09C 1/3676; C09C 1/42; C09C 3/10; Y02P 20/582
See application file for complete search history.

(56) References Cited

U.S. PATENT DOCUMENTS 4,911,700 A * 3/1990 Makoui ..... A61L 15/28 162/157.6
5,114,534 A 5/1992 Rachor et al.
6,200,404 B1 * 3/2001 Andersen ..... B29C 43/02 156/245
2011/0277947 A1 * 11/2011 Hua ..... D21H 21/10 162/149
2013/0292075 A1 11/2013 Laine et al.
2014/0004326 A1 * 1/2014 Petersen ..... D04H 1/425 428/219
2016/0289893 A1 10/2016 Martin et al.
2016/0319482 A1 11/2016 Ben et al.

OTHER PUBLICATIONS

PCT International Search Report and Written Opinion, Application No. PCT/US18/55381, dated Jan. 7, 2019.
Brännvall et al., "Fibre surface modifications of market pulp by consecutive treatments with cationic and anionic starch", Nordic Pulp and Paper Research Journal, 2007, vol. 22, No. 2, pp. 244-248.
Hollertz et al., "Chemically modified cellulose micro- and nanofibrils as paper-strength additives", Springer, Cellulose, 2017, vol. 24, No. 9, pp. 3883-3899.
The extended European search report, Application No. 18866642.4, dated May 10, 2021.
Brazilian Office Action, Application No. BR112020007161-7, dated Jun. 21, 2022.

* cited by examiner

PRIOR ART FIG. 1

METHOD TO PRODUCE COMPOSITE-ENHANCED MARKET PULP AND PAPER

RELATED APPLICATIONS

This application is the national phase entry of international application PCT/US2018/055381, filed under the authority of the Patent Cooperation Treaty on Oct. 11, 2018, published; which claims priority to U.S. Provisional Application No. 62/571,389, filed under 35 U.S.C. § 111(b) on Oct. 12, 2017. The entire disclosure disclosures of all the aforementioned applications are hereby incorporated herein by reference for all purposes.

BACKGROUND

The present invention relates generally to the field of cellulosic pulp processing, and more specifically to a process for making a market pulp with unique properties that can be used to make paper products having improved properties.

Referring to FIG. 1, "Market pulp" is an industry term describing the partially dried end product of a pulp mill, which is sold as wet lap, or dry lap in bales, sheets, or rolls to paper mills where is it is re-slushed or re-pulped to make a final paper product. Market pulp thus includes the digested, washed, and often bleached celluloid fibers, along with processing aids. In some cases, wet lap may be used directly without much drying as furnish for a paper mill, but generally only if the pulp mill and paper mill are located within a short shipping distance from each other.

Certain additives may be combined with the fibrous pulp slurry in an attempt to improve paper properties like strength, smoothness, brightness, etc. It has been found, however, that the benefits of some of these additives are lost when the slurries are first dried to make a market pulp; they do not persist in the final paper product upon re-pulping and drying a second time.

U.S. Pat. No. 9,458,570 to Jabar, et al., —incorporated herein in its entirety—describes a composite filler composition that may be utilized in fiber slurries that may be used in making paper or paperboard products. The composite filler requires three components: a filler material, a binder, and a reactant. The filler is preferably an inexpensive particle, such as clay, calcium carbonate, titanium dioxide, grain hulls, etc.; or it may be a fiber including a cellulose fiber or pulp. The binder for cellulose-based materials is a gum, latex, or starch-like material of various sources. The reactant is a compound that chemically joins the binder and filler together so as to encapsulate or isolate the filler material particle, thereby reducing any adverse impact or disruption the filler material has on the ultimate paper product.

US20150033983 to Bilodeau, et al., describes some building products made from cellulosic materials. US20150167243 and US20170073893, both to Bilodeau, et al., describe refining processes and parameters that may be used to make cellulose nanofibrils with good efficiency.

Liping He, et al., *A method for determining reactive hydroxyl groups in natural fibers*, Carbohydrate Research, 348 (2012) 95-98, show an analytical method for determining hydroxyl groups in natural fibers by back titration with isocyanate (IBT method). They report that only a fraction ($^{105}/_{1037}$) of theoretically available hydroxyl groups were found empirically, and speculated that this was due in part to hydrogen bonding between cellulose chains. This method may also detect internal hydroxyl groups rather than only those present on the surface.

All references cited herein are incorporated herein in their entireties

It would be advantageous if there could be developed improved processes for making market pulps, and, in particular, if paper products having superior properties could be developed as a result of the process.

SUMMARY OF THE INVENTION

One aspect of this invention provides an improved composite market pulp comprising cellulose fibers, and a composite additive that includes: (1) a hydroxyl compound such as a starch or a high aspect, high surface area cellulose, such as cellulose nanofibrils, cellulose nanocrystals, or cellulose microfibers, and (2) a crosslinking compound that crosslinks a portion of the hydroxyl groups on the hydroxyl compound. A further starch binder is optional, but not required.

A novel method to produce an enhanced market pulp is also disclosed. The method involves blending a fiber slurry with cellulose microfibrils and/or cellulose nanofibrils, (and, optionally, other materials which enhance the properties of the composite, including soluble or water suspended colloid or hydrocolloid binders, preferably a cooked starch paste, latex or organic resins, and/or pigments, inorganic minerals, or insoluble organic particles); and a protecting group, with a concentration, temperature, and time chosen so as to react and crosslink a fraction of the hydroxyl groups on the cellulose fiber, cellulose microfibrils, cellulose nanofibrils, and any soluble or hydrocolloid binders present in the mixture. The reacted fiber composite is then processed into market pulp using conventional dry lap pulp machines.

Examples of suitable crosslinking compound include aldehydes, dialdehydes (including, without limitation, ethanedial, also referred to as glyoxal, including blocked and straight or unblocked glyoxal-based insolubilizers), aliphatic epoxy resins, melamine formaldehyde resins, ammonium zirconium carbonates, potassium zirconium carbonate, blocked isocyanates, and mixtures thereof. A preferred protecting group is glyoxal.

Enhanced market pulp manufactured using this invention has been observed on re-pulping to produce a fiber slurry that releases water more easily—i.e., has a higher Freeness (CSF) than a comparable fiber slurry containing never-dried components. This allows, for example, a higher concentration of cellulose microfibrils, cellulose nanofibrils, and/or starch, to be used without impacting production rates in wet laid processes. Typically, the production rate of these processes are highly dependent on the rate of water release from the fiber slurry. Improved strength and lower air permeability of the wet laid article and lower costs are possible benefits of the invention compared to prior art. Unexpectedly, this dewatering improvement was observed without requiring the use of a binder, such as starch, as taught in U.S. Pat. No. 9,458,570.

This technology overcomes several limitations of the current art. The first is that paper mills which purchase market pulp for the production of paper are often limited in their ability to modify the fibers sufficiently to develop the desired paper properties. These include capacity limitations of existing fiber processing equipment, such as refining capacity, additive processing capability or capacity, such as starch cooking, or the ability to generate cellulose microfibrils or cellulose nanofibrils on-site. This invention overcomes this limitation by providing a composite market pulp with enhanced properties that contain the appropriate composition of fiber and additives and requires little to no additional processing at the paper mill.

The second limitation addressed by this technology is that the effectiveness of many additives added to market pulp is often reduced significantly once the market pulp is dried. This is especially true of cellulose microfibrils and cellulose nanofibrils whose strength and porosity controlling properties are compromised upon initial drying. The effectiveness of common strength additives used in paper making, such as starch and polyacrylamides, are also significantly diminished once the furnish is initially dried to form the market pulp. This phenomenon has prevented pulp mills from incorporating these additives into market pulps today. The invention described herein minimizes the loss in performance of these materials upon drying and allows for the production of dried market pulp with enhanced properties that can be utilized by downstream operations with minimal loss of performance upon slushing and forming into fiber containing products, such as paper webs or formed fiber articles.

Other advantages and features are evident from the following detailed description.

DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings, incorporated herein and forming a part of the specification, illustrate the present invention in its several aspects and, together with the description, serve to explain the principles of the invention. In the drawings, the thickness of the lines, layers, and regions may be exaggerated for clarity.

Figure 1:
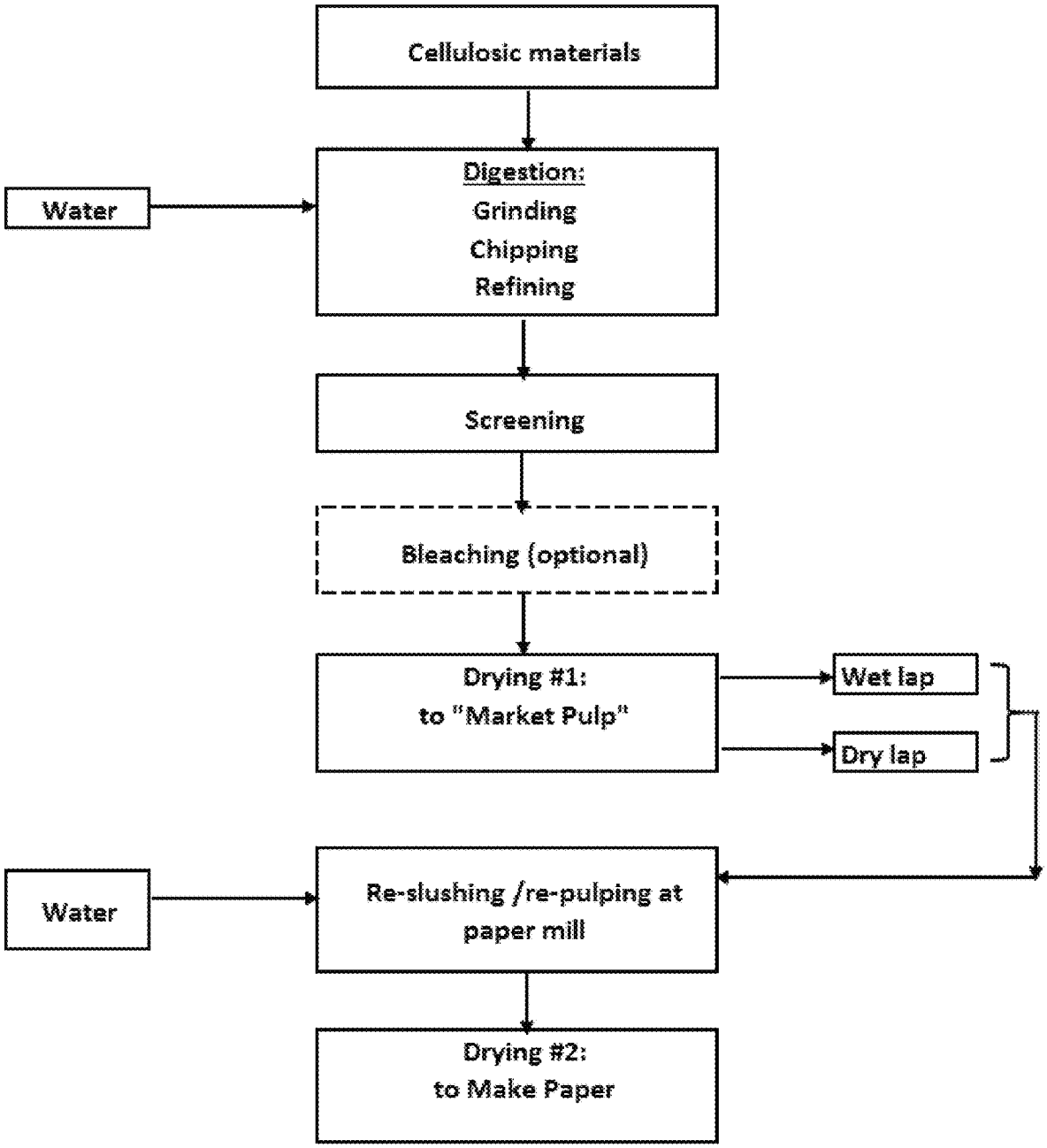
FIG. 1 is a generalized prior art process for preparing a market pulp that is then re-pulped to make a paper product. It illustrates the two drying steps discussed herein; once moderately to wet lap or more extensively to dry lap market pulp, for shipping to a paper mill or other end user, and a second time when the paper product is dried.

Various aspects of this invention will become apparent to those skilled in the art from the following detailed description of the preferred embodiment, when read in light of the accompanying drawings.

DETAILED DESCRIPTION

Unless defined otherwise, all technical and scientific terms used herein have the same meaning as commonly understood by one of ordinary skill in the art to which the invention belongs. Although any methods and materials similar or equivalent to those described herein can be used in the practice or testing of the present invention, the preferred methods and materials are described herein. All references identified by citation herein, including books, journal articles, published U.S. or foreign patent applications, issued U.S. or foreign patents, and any other citations, are each incorporated by reference in their entireties, including all data, tables, figures, and text presented in the cited references.

Numerical ranges, measurements, and parameters used to characterize the invention—for example, angular degrees, quantities of ingredients, polymer molecular weights, reaction conditions (pH, temperatures, charge levels, etc.), physical dimensions and so forth—are necessarily approximations; and, while reported as precisely as possible, they inherently contain imprecision derived from their respective measurements. Consequently, all numbers expressing ranges of magnitudes as used in the specification and claims are to be understood as being modified in all instances by the term "about." All numerical ranges are understood to include all possible incremental sub-ranges within the outer boundaries of the range. Thus, a range of 30 to 90 units discloses, for example, 35 to 50 units, 45 to 85 units, and 40 to 80 units, etc. Unless otherwise defined, percentages are wt/wt %.

Cellulose nanofibrils (CNF) are also known in the literature as microfibrillated cellulose (MCF), cellulose microfibrils (CMF), and nanocellulose fibers (NCF). Despite this variability in the literature, the present invention is applicable to microfibrillated fibers, microfibrils, and nanofibrils, independent of the actual physical dimensions; and all these terms may be used essentially interchangeably in this disclosure. They are generally produced from wood pulps by a refining, grinding, or homogenization process involving shear force (as described below) that governs the final size. Nanofibrils and microfibers are both characterized by a high aspect ratio, such that their lengths exceed their diameters by 100 fold or more. Nanofibrils have at least one dimension (e.g., diameter) in the nanometer range from about 1 to about 200 nm, more typically from about 20 to about 100 nm. Microfibers have diameters in the micrometer range, for example from 1 μm to about 100 μm. Fiber lengths may vary from 0.1 mm to as much as about 4.0 mm depending on the type of wood or plant used as a source and the degree of refining. In some embodiments, the "as refined" fiber length is from about 0.2 mm to about 0.5 mm. Fiber length is measured using industry standard testers, such as the Tech-Pap Morphi Fiber Length Analyzer. Within limits, as the fiber is more refined, the % fines increases and the fiber length decreases.

Freeness is a standard measure in the paper industry and measures the capacity of fibers to imbibe water or, conversely, the "dewatering" or drainability of water from the pulp. While there are multiple methods for measuring freeness, one frequently used measure is the Canadian Standard Freeness or CSF (TAPPI Standard Method T-227), which is the volume (in ml) of water that is collected in an overflow side stream as water from a liter of 3% solids fiber slurry at 20° C. is drained through a screen and orifice. A higher CSF means less water is absorbed and held by the fiber mat.

Cellulosic and Pulping Materials

Cellulose, the principal constituent of "cellulosic materials," is the most common organic compound on the planet. The cellulose content of cotton is about 90%; the cellulose content of wood is about 40-50%, depending on the type of wood. "Cellulosic materials" includes native sources of cellulose, as well as partially or wholly delignified sources of cellulose. Wood pulps are a common, but not exclusive, source of cellulosic materials. Tree limbs, fallen trees, diseased trees, saw mill residuals, etc., are also good sources of wood derived particulate materials. "Salvage" woods, those that otherwise would simply decay or be burned to release carbon dioxide, are especially useful, but certainly not the only sources of wood derived materials.

Figure 2:
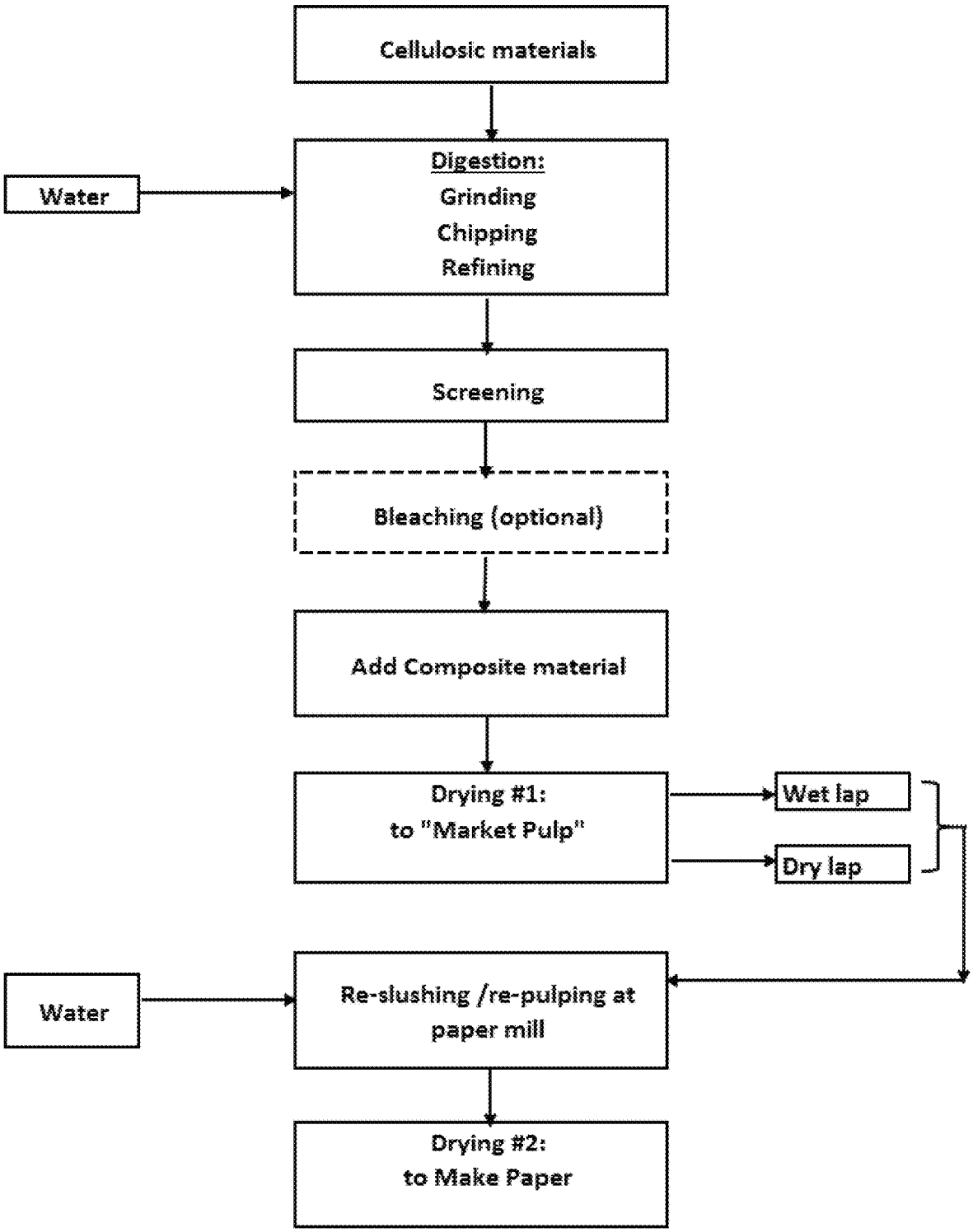
FIG. 2 is a generalized process analogous to FIG. 1, but showing the additional step of adding a composite material to the pulp prior to the first drying to form a composite-enhanced market pulp.
Figure 3:
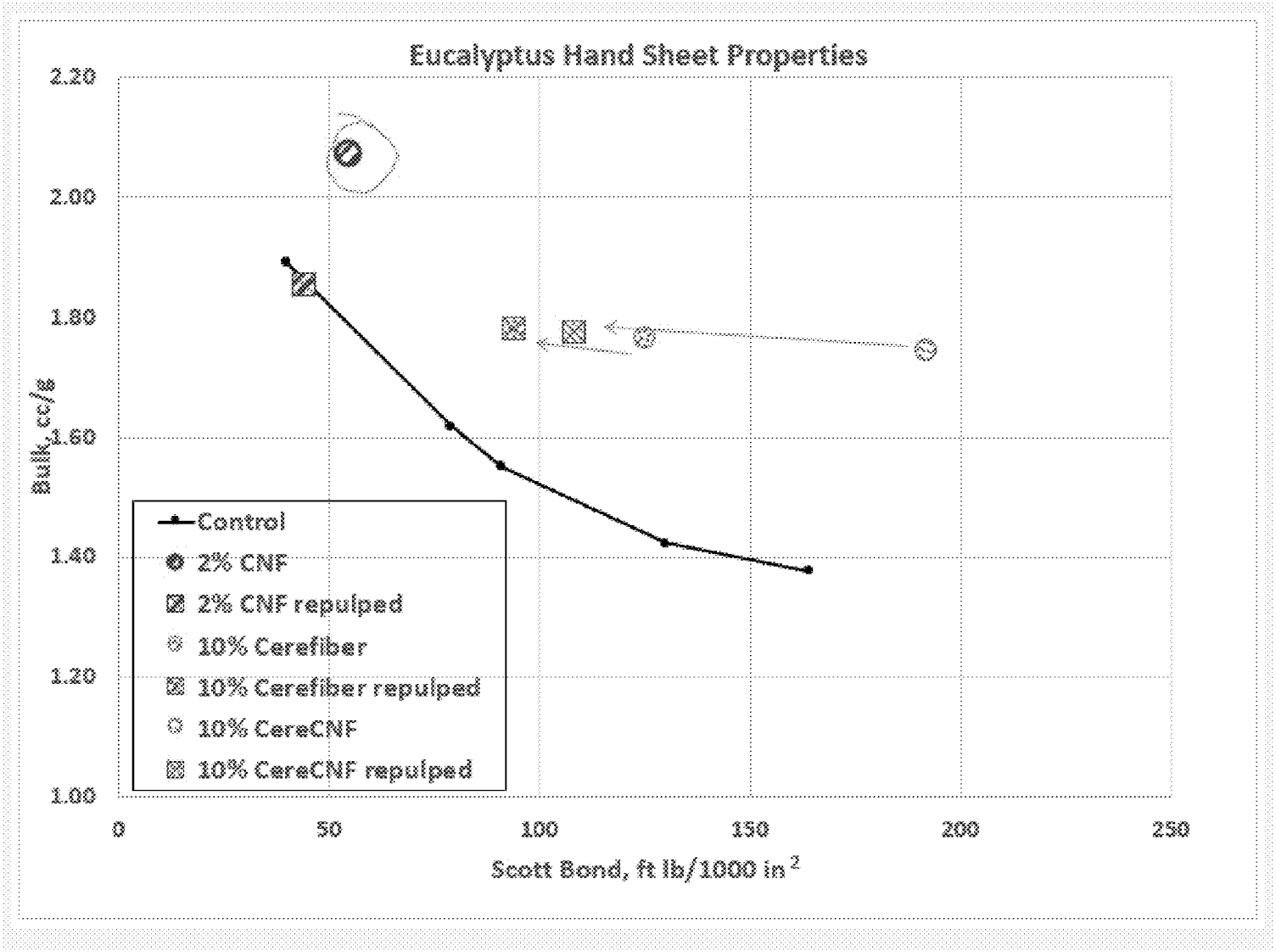
FIG. 3 is a chart relating bulk and bond properties of paper hand sheets prepared in the Example 2.
Figure 4:
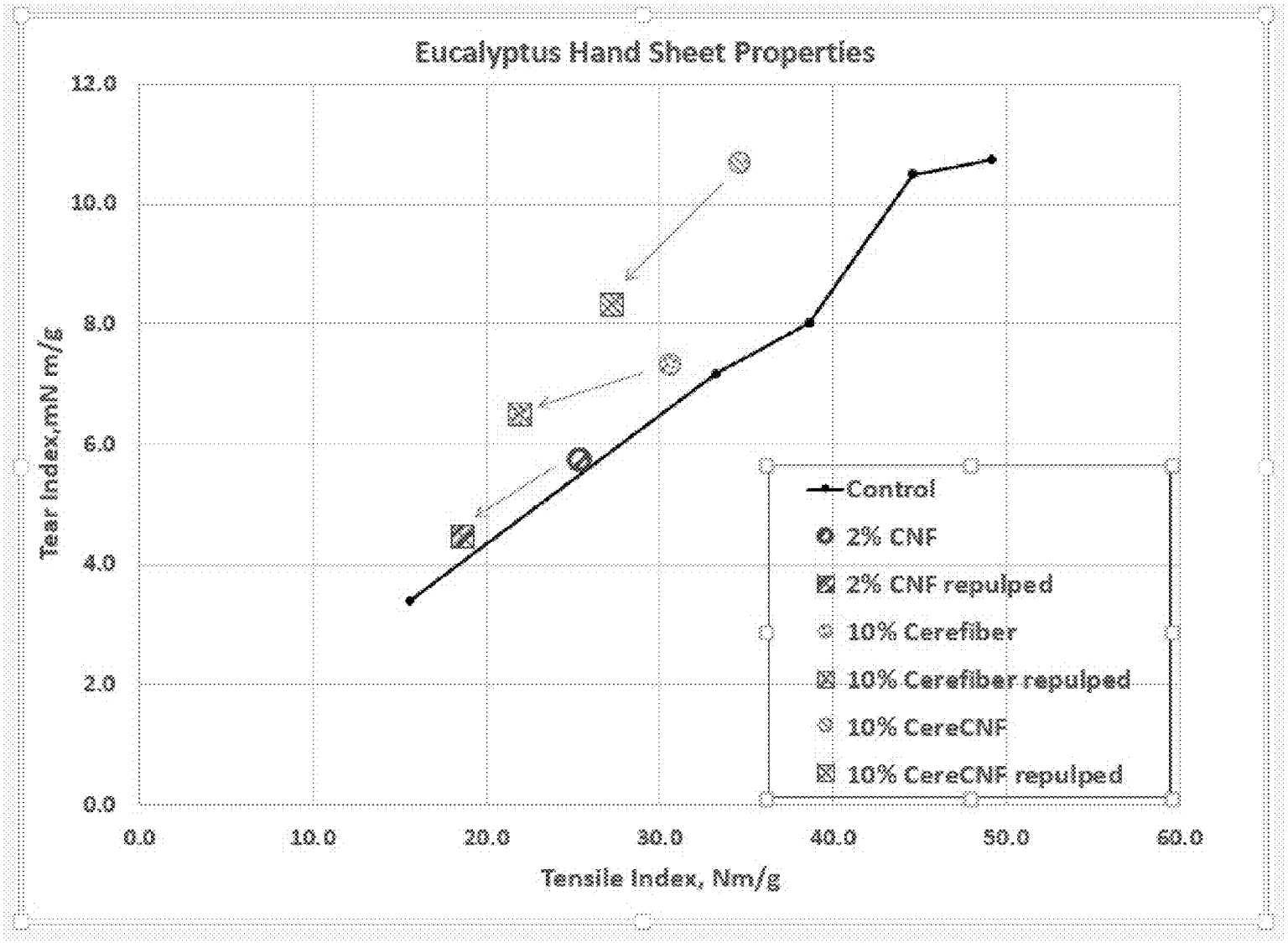
FIG. 4 is a chart relating tear and tensile properties of paper hand sheets prepared in the Example 2.
Figure 5:
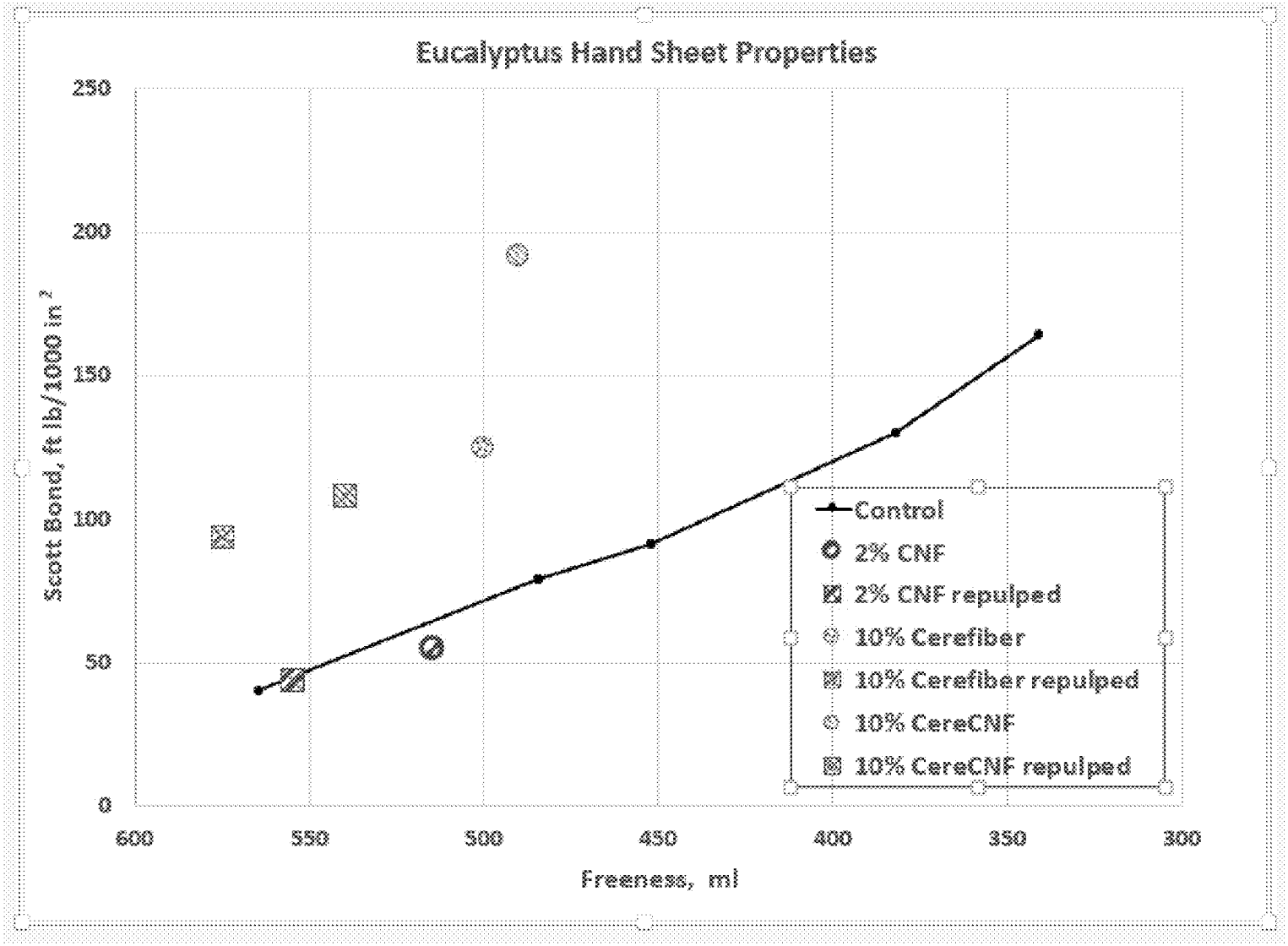
FIG. 5 is a chart relating bond and freeness (CSF) properties of paper hand sheets prepared in the Example 2.
Figure 6:
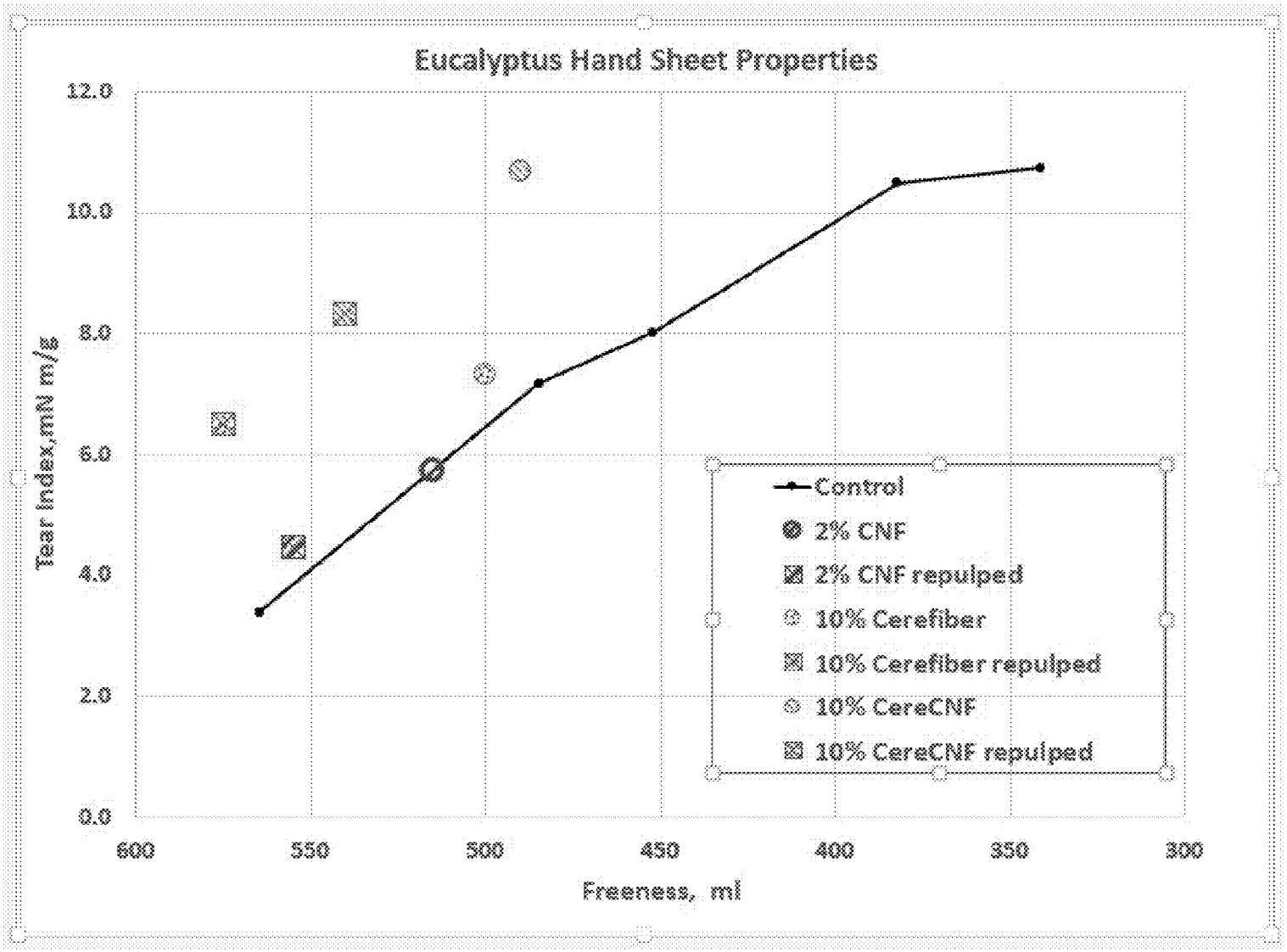
FIG. 6 is a chart relating tear and freeness (CSF) properties of paper hand sheets prepared in the Example 2.

FIG. 2 of US 20150033983 (incorporated herein by reference) presents an illustration of some of the components of wood, starting with a complete tree in the upper left, and, moving to the right across the top row, increasingly magnifying sections as indicated to arrive at a cellular structure diagram at top right. The magnification process continues downward to the cell wall structure, in which S1, S2, and S3 represent various secondary layers, P is a primary layer, and ML represents a middle lamella. Moving left across the bottom row, magnification continues up to cellulose chains at bottom left. The illustration ranges in scale over 9 orders of magnitude from a tree that is meters in height through cell structures that are micron (μm) dimensions, to microfibrils and cellulose chains that are nanometer (nm) dimensions. In the fibril-matrix structure of the cell walls of some woods, the long fibrils of cellulose polymers combine with 5- and 6-member polysaccharides, hemicelluloses and lignin.

It is evident that trees can provide both the celluloid fibers for paper-making, and the high aspect ratio, high surface area cellulose materials for preparing the composite material described below.

General Pulping and CNF Processes

FIG. 1 shows a generalized pulping process to produce a market pulp. Pulp comprises wood fibers capable of being slurried or suspended in a liquid and then deposited on a screen to form a sheet of paper. There are two main types of pulping techniques: mechanical pulping and chemical pulping. In mechanical pulping, the wood is physically separated into individual fibers. In chemical pulping, the wood chips are digested with chemical solutions to solubilize a portion of the lignin and thus permit its removal. The commonly used chemical pulping processes include: (a) the Kraft process, (b) the sulfite process, and (c) the soda process. These processes need not be described here as they are well described in the literature, including Smook, Gary A., Handbook for Pulp & Paper Technologists, Tappi Press, 1992 (especially Chapter 4), and the article: "Overview of the Wood Pulp Industry," Market Pulp Association, 2007 (both of which are incorporated herein by reference). The wood pulp produced in the pulping process is usually separated into a fibrous mass and washed. It may be used without drying as "wet lap" or it may be dried to "dry lap" or market pulp for shipping to paper mills that may further process the market pulp.

A generalized process for producing nanocellulose fibrils or fibrillated cellulose is disclosed in PCT Patent Application No. WO 2013/188,657, which is incorporated by reference herein in its entirety. The process includes a step in which the wood pulp is mechanically comminuted in any type of mill or device that grinds the fibers apart. Such mills are well known in the industry and include, without limitation, Valley beaters, PFI mills, single disk refiners, double disk refiners, conical refiners, including both wide angle and narrow angle, cylindrical refiners, homogenizers, microfluidizers, and other similar milling or grinding apparatuses. These mechanical comminution devices need not be described in detail herein, since they are well described in the literature, for example, Smook, Gary A., Handbook for Pulp & Paper Technologists, Tappi Press, 1992 (especially Chapter 13). Tappi standard T200 describes a procedure for mechanical processing of pulp using a beater. The process of mechanical comminution or breakdown, regardless of instrument type, is generally referred to in the literature as "refining."

The extent of refining may be monitored during the process by any of several means. Certain optical instruments can provide continuous data relating to the fiber length distributions and percent fines, either of which may be used to define endpoints for the comminution stage. Within limits, as the fiber is more refined, the % fines increases and the fiber length decreases. Fiber length is measured using industry standard testers, such as the TechPap Morphi Fiber Length Analyzer, which reads out a particular "average" fiber length. In some embodiments, the "as refined" fiber length is from about 0.1 mm to about 0.6 mm, or from about 0.2 mm to about 0.5 mm.

Fibril-filler material comprises microfibers or nanofibrils that have been refined to a high degree and have a high surface area and correspondingly a high amount of exposed hydroxyl groups. The amount of fibril-filler material used in market pulp may range from about 1 wt % to about 40 wt % based on the dry weight of the paper-making fiber materials. In some embodiments, the amount of fibril-filler material may range from about 5 wt % to about 20 wt %; in other embodiments, the amount of fibril-filler material may range from about 5 wt % to about 15 wt %.

Composite Materials

Composite materials are those materials added to the market pulp to make it a composite-enhanced market pulp. Composite materials comprise at least two components: (1) a hydroxyl-containing compound with a great number of exposed surface hydroxyl groups; and (2) a crosslinking compound for crosslinking a portion of the surface hydroxyl groups.

The hydroxyl compound may be a native, unmodified starch, or a modified starch, as these naturally contain large numbers of hydroxyl groups. Starches can be isolated from corn, waxy maize, potato, tapioca, wheat, or rice. The starch may further be modified or derivatized into oxidized, cationic, anionic, acid-thinned, ethylated, and aldehyde starches.

The hydroxyl compound may also be a high aspect ratio, high surface area cellulose materials for preparing the composite material include nanocellulose crystals (such as may have been separated from amorphous sections of fibers or fibrils), cellulose nanofibrils, and cellulose microfibers. "High aspect ratio" refers to the linear length-diameter ratio that is known for CNF to be 100 or more, e.g., 100 to 10,000. "High Surface area" refers to the additional area exposed as fibrils liberated from the cellulose macrofibers. It is generally accepted that nano-scale CNF has a surface area at least 100 times (e.g., 100 to 10,000 fold or 100 to 1,000 fold) that of an equivalent weight of cellulose pulp. The high surface area of CNF fibrils exposes a significantly higher number of surface hydroxyl groups that may participate in crosslinking reactions.

The composite material may also comprise a combination of a starch and a high aspect ratio, high surface area cellulose material such as those described above.

The "crosslinking compound" is a compound that reacts with two or more hydroxyl groups on different molecules in an aqueous environment to covalently connect them together. The covalent bond is generally irreversible under the conditions of pulping. The two molecules may include the pulp fibers, but more importantly may include any of the hydroxyl-containing compounds in the composite materials, such as the starch, or the nanocellose fibers or crystals, in the market pulp slurry. The crosslinking compound is used in sufficient quantity to crosslink a portion, but not all, of the surface hydroxyls to form a three dimensional (3-D) matrix of crosslinked fibers—conceptually not unlike fiberglass insulation, which comprises randomly spun glass fibers crosslinked with a sizing compound. In some embodiments, for example, at least 5% of surface hydroxyl groups are crosslinked. In some embodiments, at least 10%, at least 20%, at least 30%, or at least 40% are crosslinked. In some embodiments, from 5% to 60% are crosslinked, from 5% to 50% are crosslinked, from 10% to 40% are crosslinked, or from 5% to 40% are crosslinked. In some embodiments, from 5% to 30% are crosslinked, from 5% to 25% are crosslinked, from 10% to 30% are crosslinked, or from 5% to 20% are crosslinked. The amount of crosslinking compound in the market pulp can range from about 0.1 wt % to about 1 wt %, for example from about 0.2 wt % to about 0.8 wt %, based upon the dry weight of the market pulp.

Without being bound by any theory, it is believed that the 3-D matrix protects a portion of the remaining un-crosslinked hydroxyl groups from hydrogen bonding to one another as the pulp is dried (first time) to a market pulp. By reacting and crosslinking some of the exposed hydroxyl groups, the CNF (i.e., a high aspect, high surface area cellulose material) cannot completely conform or adsorb onto the fiber surface. The closer the CNF is allowed to contact the cellulose fiber surface, the stronger the hydrogen bonding is and the less reversible the bonds are. It is believed that excessive irreversible hydrogen bonding on first drying of market pulp is responsible for the poorer performance shown in re-pulped papers made without composite enhanced market pulp. Steric hindrance from the 3-D crosslinked matrix prohibits the close association and irreversible hydrogen bonding that would otherwise occur in dried market pulp.

In this sense, the crosslinking compounds differ from the reactants of U.S. Pat. No. 9,458,570 to Jabar, et al. Rather than encapsulating the filler particle with binder to reduce the adverse effects of the filler particle's presence in the slurry, the present invention crosslinks only a portion of the surface hydroxyl functions to form a 3-D lattice or matrix. Without being bound by any theory, it is believed that this 3-D matrix is important to the improved properties exhibited by the composite-enhanced market pulps (see examples and Figures). It is thought that the loosely crosslinked matrix in the enhanced market pulp is fully capable of rehydration upon re-slushing or re-pulping (the terms are synonymous herein), such that the matrix relaxes and exposes fresh surface hydroxyl groups for hydrogen bonding in the twice-dried papers. These hydroxyl groups newly exposed upon re-slushing had been protected from hydrogen bonding in the first drying step by reason of the protection afforded by the 3-D matrix structure.

Examples of suitable crosslinking compounds include aldehydes, especially dialdehydes having from 2 to 5 carbons (including, without limitation, ethanedial, also referred to as glyoxal), propanedial, and butanedial; including blocked and straight or unblocked glyoxal-based insolubilizers; aliphatic epoxy resins; melamine formaldehyde resins; ammonium zirconium carbonates; potassium zirconium carbonate; blocked isocyanates; and mixtures thereof. Preferred crosslinking groups include lower (2-4 carbons) dialdehydes, like glyoxal.

Although not required to achieve the benefits of the invention, a starch binder may optionally be included either as the sole hydroxyl compound or in a combination with a high aspect ratio, high surface area fiber-type hydroxyl compound. Suitable binders for cellulose-based paper products include, but are not limited to, native and modified starches, gums, latex, or derivatized cellulose products. Starches can be isolated from corn, waxy maize, potato, tapioca, wheat, or rice. The starch may further be modified into oxidized, cationic, anionic, acid-thinned, ethylated and aldehyde starches. The amount of binder in the market pulp can range from about 0.1 wt % to about 15 wt %, for example from about 2 wt % to about 10 wt %.

Composite Materials may be prepared separately and added to a pulp to make an "enhanced pulp" of the enhanced pulp may be created in the process by simply adding the components under conditions that favor some crosslinking. The components are heated to above the minimum temperature required to initiate the crosslinking reaction, typically 80° C. or higher. Vigorous mixing helps to improve the uniformity of the reaction. The reaction rate is typically very fast and does not require a long time at temperature to proceed to completion.

When prepared separately, a small portion of the fibrous pulp may be segregated and a "stock" preparation of composite material may be made by adding the starch, or a high-aspect cellulose like CNF, or nanocellulose crystals, or both, to the small portion of fibers along with a suitable crosslinking compound. Since the crosslinking reaction may involve heat, it may be economically advantageous to heat only the small portion required for the "stock" preparation. This also facilitates varying the overall amount of composite material in the enhanced pulp, by varying the ratio of stock preparation to untreated pulp in the final mixture.

The invention has been described above, but will be further exemplified by the following specific examples, which are intended only to illustrate the invention and not to limit it in any way.

EXAMPLES

Example 1

Enhanced Market Pulp with Nanofiber

Bleached Eucalyptus Kraft Pulp (BEKP) market dry lap pulp from Fibria was used as the cellulose fiber and also used to produce cellulose nanofibrils (CNF) used in this example. CNF was refined as described in US2017/0073893 to a fines level of from 35% to about 95%. In a first part, handsheets were prepared from the unrefined pulp (Sample 1). Another portion of the pulp was dried to a market pulp and re-slushed to make paper. (Sample 1P. Note, throughout the Examples, a "P" suffix on a sample number indicates a re-slushed and twice-dried paper.) Selected properties of the two papers are given in Table 1, below. Sample 1 serves as the control.

In a second part of the experiment, three enhanced market pulps were prepared by the addition of a composite material according to the invention. In each case, the enhanced market pulp contained a crosslinking compound, glyoxal, at 0.35% or 0.7%; combined with 5% by weight CNF, either alone (Sample 2) or mixed with a starch to form a "Cere-" product. The starch was a blend of 30% cationic starch and 70% pearl corn starch from Tate & Lyle. Sample 3 also contained 5% starch (CNF and starch in 1:1 ratio), while Sample 4 contained 2.5% starch (CNF and starch in 2:1 ratio). The enhanced pulps were used wet to make handsheets (Samples 2, 3, and 4) or were dried to dry lap and re-slushed to make handsheets (Samples 2P, 3P, and 4P). Handsheets were tested in accordance with standard TAPPI procedures. Table 1 gives some properties of these enhanced market pulp handsheets also. All have a relatively consistent basis weight at 64-67 g/m$^2$.

TABLE 1

Properties of sample various handsheets

| Sample No. | | Basis weight g/m2 | Ibond ft-lb/1000 in$^2$ | % increase | Tensile Index Nm/g | % increase |
|---|---|---|---|---|---|---|
| 1 | Unrefined Eucalyptus | 66.35 | 28 | | 20.9 | |
| 1P | Repulped Eucalyptus | 64.34 | 14 | −50% | 13.6 | −35% |
| | With Composite material- | | | | | |
| 2 | 5% CNF | 66.04 | 58 | 107% | 31.7 | 52% |
| 3 | 5% CNF 1:1 Cere (100 ppt) | 66.26 | 160 | 471% | 46.6 | 123% |
| 4 | 5% CNF 2:1 Cere (50 ppt) | 66.9 | 98 | 250% | 37.9 | 81% |
| 2P | 5% CNF-repulped | 65.85 | 30 | 7% | 24.2 | 16% |
| 3P | 5% CNF 1:1 Cere (100 ppt) repulped | 65.92 | 87 | 211% | 29.3 | 40% |
| 4P | 5% CNF 2:1 Cere (50 ppt) repulped | 65.82 | 52 | 86% | 24.7 | 18% |

From the data it can be seen that re-pulping (or re-slushing) unrefined pulp produced a deterioration in bond and tensile index properties compared to the control (Sample 1). This is consistent with expectations, in that re-pulping has often shown deterioration in properties due to reduced ability to form hydrogen bonds when re-slushed.

But the addition of the composite material produced impressive increases in the handsheet properties. The wet lap composite-enhanced pulps (Samples 2, 3, and 4) produced tremendous increases in bond and tensile properties, (for Sample 3, more than a 4-fold increase in bond and a 2-fold increase in tensile index). The re-pulped dry lap papers (Samples 2P, 3P, and 4P) did not perform as well as the wet-lap, but did perform much better than the control Sample 1, showing increases in bond from 7% to 200+%, and increases in tensile index from 16% to 40%. This demonstrates that the composite-enhanced market pulps can be used without loss of paper properties upon second drying, so that marketing and use for re-pulping in a paper mill at locations distant from the pulp mill can be attained.

Example 2

Enhanced Market Pulp—All Variations

Bleached Eucalyptus Kraft Pulp (BEKP) market dry lap pulp from Fibria was used as the cellulose fiber and also used to produce cellulose nanofibrils (CNF) used in this example. The starch was a blend of 30% cationic starch and 70% pearl corn starch from Tate & Lyle. The crosslinking compound was CereGel A™, a glyoxal available from Cerealus, LLC (Waterville, Me.).

Sample 11 is a true "unrefined" control as in Example 1. For additional controls, the rest of a standard five point PFI refining curve (0, 1500, 3000, 4500, 6000 revolutions) was generated (Samples 11.1 to 11.4) using the BEKP dry lap market pulp. This process simulates the process used in paper-making operations to increase the degree of fiber bonding and, therefore, increase the strength of paper made from these fibers. Increased refining, however, also slows the rate of production by reducing the rate of dewatering (decreasing CSF). Laboratory hand sheets at each test point were produced and tested in accordance with standard TAPPI procedures for the following properties:

Basis Weight
Caliper
Bulk
Tensile Index
Tear Index
Scott Bond
Canadian Standard Freeness (CSF)

No other additives were used to produce the control sheets. Data is presented in Table 2 and in FIGS. 3-6. For Sample 11, the tensile index, Scott-Bond, and Tear Index all improve with increasing refining, but at the cost of lower CSF values, meaning slower dewatering and drying of the pulp. These controls are shown as the connected solid line in FIGS. 3-6.

An additional control was prepared (Sample 12/12P) by adding 2% by weight of CNF, but without a starch or a crosslinking compound. Sample 12 (used wet, not re-pulped) shows paper strength properties roughly between unrefined and refined at 1500 PFI revs (Sample 11.1). Re-pulped Sample 12P shows poorer properties as expected, and loses most of the gains compared to minimally refined at 1500 revs. Without being bound by any theory, the loss of strength properties when CNF alone is added is believe to be due to the inability to form a 3-D crosslinked matrix which then would relax upon re-slushing. Instead, the CNF is believed to undergo strong hydrogen bonding with one another and other fibers that do not "relax" upon re-slushing and thus is not available for re-bonding in the twice-dried papers.

TABLE 2

Hand sheet test results (where samples 12, 12P correspond to the red markers in FIGS. 3-6, samples 13, 13P correspond to the green markers in FIGS. 3-6, and samples 14, 14P correspond to the blue markers in FIGS. 3-6.)

| | Refined pulp only | CSF, ml | mm (AA) | % | gsm | mm | cc/g | Nm/g | ft-lb/1000 in$^2$ | mNm/g |
|---|---|---|---|---|---|---|---|---|---|---|
| 11 | 0 PFI revs | 565 | 0.609 | 32.9 | 68.71 | 0.13 | 1.89 | 15.6 | 40 | 3.4 |
| 11.1 | 1500 PFI revs | 485 | 0.613 | 34.8 | 73.52 | 0.119 | 1.62 | 33.2 | 79 | 7.2 |

TABLE 2-continued

Hand sheet test results (where samples 12, 12P correspond to the red markers in FIGS. 3-6, samples 13, 13P correspond to the green markers in FIGS. 3-6, and samples 14, 14P correspond to the blue markers in FIGS. 3-6.)

| | Refined pulp only | CSF, ml | mm (AA) | % | gsm | mm | cc/g | Nm/g | ft-lb/1000 in$^2$ | mNm/g |
|---|---|---|---|---|---|---|---|---|---|---|
| 11.2 | 3000 PFI revs | 452 | 0.617 | 34.4 | 69.6 | 0.108 | 1.55 | 38.7 | 91 | 8.0 |
| 11.3 | 4500 PFI revs | 382 | 0.613 | 33.6 | 68.85 | 0.098 | 1.42 | 44.6 | 130 | 10.5 |
| 11.4 | 6000 PFI revs | 341 | 0.618 | 33.7 | 68.98 | 0.095 | 1.38 | 49.2 | 164 | 10.7 |
| 12 | 2% CNF | 515 | 0.604 | 38.8 | 68.47 | 0.142 | 2.07 | 25.4 | 55 | 5.7 |
| 12P | 2% CNF repulped | 555 | 0.606 | 39.7 | 67.37 | 0.125 | 1.86 | 18.6 | 44 | 4.5 |
| 13 | 10% CereFiber | 500 | 0.6 | 36.1 | 69.69 | 0.123 | 1.76 | 30.6 | 125 | 7.3 |
| 13P | 10% CereFiber repulped | 575 | 0.597 | 35.8 | 78.6 | 0.14 | 1.78 | 21.9 | 94 | 6.5 |
| 14 | 10% CereCNF | 490 | 0.591 | 44.8 | 70.48 | 0.123 | 1.75 | 34.7 | 192 | 10.7 |
| 14P | 10% CereCNF repulped | 540 | 0.603 | 39.9 | 75.44 | 0.134 | 1.78 | 27.2 | 108 | 8.3 |

Two composite-enhanced sample market pulps were prepared using Ceregel™ glyoxal as a crosslinking agent at about 7% of the composite material weight (i.e., about 0.7% of the dry pulp weight since composite material is 10% of pulp dry weight). Handsheets were prepared from wet lap (Samples 13 and 14), and each pulp sample was dried and re-pulped to make a handsheet paper (Samples 13P and 14P). Sample 13 is made with 10 wt % of a composite of Ceregel/BEKP/starch, where the starch is coated on a small portion of the BEKP fibers before mixing in the pulp slurry. Sample 14 is made with 10 wt % of a composite of Ceregel/CNF/Starch (1:1 ratio or ~5% each) where the starch is coated on a small portion of the CNF fibers before mixing in the pulp slurry.

Samples 13 and 14, made according to the invention, show considerable improvement in strength properties without significant loss of Freeness. This is true not only in the wet lap formulations (Sample 13 and 14), but surprisingly these improved properties are also present in the re-pulped samples (13P and 14P) when compared to the unrefined control.

This improvement is seen in the FIGS. 3-6 as well. The additional control samples 12 and 12P (red/crosshatched mark) both lie close to the standard refined control (black solid line), except for a probable outlier in FIG. 3. Additionally, the re-pulped and twice dried papers (square marker) produce poorer results than the wet-lap once-dried papers (round marker). This pattern is repeated for the composite-enhanced samples, where the square markers are left, or below, or both of the round markers. Sample 12 (BEKP/Starch composite; green dotted marker) is to the right, or above, or both of the red square and control line. Similarly the (CNF/Starch composite; blue hatched marker) of Sample 14 is to the right, or above, or both of the red square and control line, typically even more than for Sample 12.

Example 3

Enhanced Market Pulp with Starch-Coated Fibers

Commercial printing and writing ("P&W") pulp and recycled "Tissue" pulp was obtained from Resolute Forest Products. Samples of these pulps were dried and pressed into handsheets as controls (Samples 15 and 16). These market pulps were enhanced with a "Cerefiber" composite material prepared by the addition of 100 parts per ton ("ppt") i.e., about 5 wt % of starch to the commercial pulps, and 0.35 wt % glyoxal crosslinking agent. The starch was a blend of 30% cationic starch and 70% pearl corn starch from Tate & Lyle. In samples 17P and 18P, the starch was added with heat to the entire mass of fibers; in Sample 19P, only 50% of the fibrous pulp was pre-treated with starch and heat, and this was then mixed with the remaining 50% of the pulp. The enhanced pulps were dried to dry lap and then re-slushed to form handsheets. Selected properties of the control and re-slushed handsheets are given in Table 3.

TABLE 3

Hand sheet test results-starch and crosslinker

| Sample No. | Set | Bulk cc/g | Tensile Index Nm/g | Tear Index mNm/g | Bond ft-lb/1000 in$^2$ | Brightness % | Opacity % |
|---|---|---|---|---|---|---|---|
| 15 | P&W pulp | 1.66 | 31.82 | 8.2 | 82 | 89.43 | 80.85 |
| 16 | Tissue Pulp | 1.72 | 24.26 | 10.1 | 65 | 77.3 | 83.09 |
| 17P | P&W Cerefiber (100 ppt starch all fiber treated) | 1.69 | 32.20 | 10.0 | 133 | 87.69 | 78.63 |
| 18P | Tissue Cerefiber (100 ppt starch all fiber treated) | 1.66 | 34.41 | 10.1 | 113 | 74.87 | 82.97 |
| 19P | Tissue Cerefiber (100 ppt starch portion of fiber treated 1:1) | 1.68 | 35.65 | 11.5 | 138 | 76.36 | 82.73 |

It can be seen that the tensile and tear index of the re-slushed handsheets are as good as or better than their respective controls. Brightness and opacity are comparable. And bond strength is considerably higher for the papers re-slushed from the enhanced market pulps.

Examples 4 and 5

Enhanced Market Pulp Made with Pre-Treated Composite Materials

Example 4

Maple "BCTMP" pulp (a type of hybrid pulp that is Bleached and both Thermo-Chemically and Mechanically digested) was obtained from Tembec, Inc. (Quebec, CA). A control handsheet was prepared with 100% Tembec BCTMP. As with Sample 19 (above), a composite material was made by reacting only a portion of the pulp fibers (~5%) with an equal weight (dry weight basis) of starch and about 0.35 wt % glyoxal crosslinking agent and heated to 85° C. The starch was a blend of 30% cationic starch and 70% pearl corn starch from Tate & Lyle. The composite material was mixed with untreated Tembec BCTMP in a ratio of 10:90 to yield about 100 ppt (or ~5 wt %) starch. The enhanced pulps were dried to dry lap and then re-slushed to form handsheets. Selected properties of the control and re-slushed handsheets are given in Table 3.

TABLE 4

Hand sheet test results - starch and crosslinker

| Test (units) | #20 Control | #21P CereFiber | Difference | % change |
|---|---|---|---|---|
| CSF, ml | 446 | 388 | −58 | −13% |
| Mutek charge, geq/dry gram | −36.1 | −33.4 | 2.7 | −7% |
| Basis weight, gsm AD | 65.4 | 67.0 | 1.6 | |
| Caliper, mm | 0.202 | 0.221 | 0.019 | |
| Bulk, cc/g | 3.09 | 3.30 | 0.21 | 7% |
| GE Brightness, % | 78.4 | 74.5 | −3.9 | −5% |
| Internal Bond, kg-cm | 0.47 | 0.51 | 0.04 | |
| Interal bond, ft-lb/1000in2 | 34 | 37 | 3 | 9% |
| tear, gf/ply | 8.2 | 10.9 | 2.7 | |
| Tear Index, $mN.m^2/g$ | 1.2 | 1.6 | 0.4 | 30% |
| tensile load, lbf | 1.9 | 2.4 | 0.6 | |
| Tensile Index, N.m/g | 8.4 | 10.6 | 2.2 | 27% |

While the Cerefiber-enhanced pulps are slightly slower to drain (CSF) and have a slightly greater charge, the impressive increases in strength properties (bond 9%, tear 30%, and tensile 26%) offset these minor negatives.

Example 5

SFK90 pulp was obtained from Resolute Forest Products, Saint-Felicien Mill (Quebec, CA). SFK90 is a Northern Bleached Softwood chemically pulped by the Kraft process (i.e., "NBSK"). A control handsheet was prepared with 100% NBSK (Sample 22). A composite material was made as in Example 4 by reacting only a portion of the pulp fibers with an equal weight (dry weight basis) of starch. The composite material was mixed with untreated NBSK at three different ratios (50 ppt, 100 ppt, and 200 ppt, corresponding to 2.5 wt %, 5 wt %, and 10 wt %) as shown in Table 5 below to make the enhanced pulps. The enhanced pulps were dried to dry lap and then re-slushed to form handsheets. Selected properties of the control and re-slushed handsheets are given in Table 5, but normalized to the control rather than in absolute numbers.

TABLE 5

Hand sheet test results - starch and crosslinker

| Sample No. | Pulp + Composite | (Data normalized to Control of 100) Tear Index | Tensile Index | Bond |
|---|---|---|---|---|
| 22 | NBSK (control) | 100 | 100 | 100 |
| 23P | NBSK + 50 ppt starch | 123 | 138 | 143 |
| 24P | NBSK + 100 ppt starch | 150 | 171 | 190 |
| 25P | NBSK + 2000 ppt starch | 129 | 204 | 303 |

These data show that papers made from enhanced market pulps retain very excellent strength properties compared to controls. This means that the market pulps that are enhanced with a crosslinked composite material retain the ability to form strong hydrogen bonds even when twice dried.

The foregoing description of the various aspects and embodiments of the present invention has been presented for purposes of illustration and description. It is not intended to be exhaustive of all embodiments or to limit the invention to the specific aspects disclosed. Obvious modifications or variations are possible in light of the above teachings and such modifications and variations may well fall within the scope of the invention as determined by the appended claims when interpreted in accordance with the breadth to which they are fairly, legally and equitably entitled.

What is claimed is:

1. A method for making a paper product from an enhanced market pulp, the method comprising:

preparing a composite material, the composite material comprising (a) nanocellulose comprising nanofibrils having exposed surface hydroxyl groups and a high aspect ratio such that their lengths exceed their diameters by 100 fold or more, and having at least one dimension ranging from 1 nm to 200 nm; and (b) a crosslinking compound capable of crosslinking some of the exposed surface hydroxyl groups on the nanocellulose to form a composite material with a three dimensional matrix structure;

adding the composite material to an aqueous pulp slurry to form a composite-enhanced market pulp;

removing water from the composite-enhanced market pulp to form an enhanced market pulp; and using the enhanced market pulp to make a paper product;

wherein the paper product has improved strength compared to a comparable paper product having nanocellulose without the crosslinking compound, with less than a 15% loss of freeness compared to the enhanced market pulp.

2. The method of claim 1, wherein the crosslinking compound is selected from the group consisting of aldehydes, resins, carbonates, and isocyanates.

3. The method of claim 2, wherein the crosslinking compound is a dialdehyde.

4. The method of claim 1, further comprising mixing a starch binder into the composite material, wherein the crosslinking compound also crosslinks a portion of the hydroxyl groups on the starch binder.

5. The method of claim 1, wherein the step of removing water from the composite-enhanced market pulp comprises compressing the pulp to remove from about 30 wt % to about 70 wt % of water.

6. The method of claim 1, wherein the step of removing water from the composite-enhanced market pulp comprises drying the pulp to remove from about 80 wt % to about 95 wt % of water.

7. The method of claim 1, wherein the composite material comprises from about 3 wt % to about 15 wt % of the dry weight of the composite-enhanced market pulp.

8. A paper product made from a composite-enhanced market pulp comprising:

paper-making cellulose fibers having hydroxyl groups; and a composite material, the composite material comprising nanocellulose comprising nanofibrils having exposed surface hydroxyl groups and a high aspect ratio such that their lengths exceed their diameters by 100 fold or more, and having at least one dimension ranging from 1 nm to 200 nm, and being at least partially crosslinked together by a crosslinking compound capable of crosslinking surface hydroxyl groups to form a composite material with a three dimensional matrix structure;

wherein the paper product has a Scott bond strength of at least 94 ft-lb/1000 $in^2$; and wherein the paper product has improved strength compared to a comparable paper product having nanocellulose without the crosslinking compound, with less than a 15% loss of freeness compared to the composite-enhanced market pulp.

9. The paper product of claim 8, wherein the crosslinking compound is selected from the group consisting of aldehydes, resins, carbonates, and isocyanates.

10. The paper product of claim 9, wherein the crosslinking compound is a dialdehyde.

11. The method of claim 1, wherein using the enhanced market pulp to make a paper product comprises:

re-pulping the enhanced market pulp to form a fibrous slurry under conditions to disrupt the three-dimensional matrix structure, thereby exposing additional hydroxyl groups; and drying the re-pulped slurry to form the paper product.

12. A method for making a paper product from an enhanced market pulp, the method comprising:

preparing a composite material, the composite material comprising (a) a starch binder having exposed surface hydroxyl groups and comprising a blend of cationic starch and pearl corn starch; and (b) a crosslinking compound capable of crosslinking some of the exposed surface hydroxyl groups of the starch binder to form a composite material with a three dimensional matrix structure;

adding the composite material to an aqueous pulp slurry to form a composite-enhanced market pulp;

removing water from the composite-enhanced market pulp to form an enhanced market pulp; and using the enhanced market pulp to make a paper product;

wherein the paper product has a bond strength of at least 113 ft-lb/1000 $in^2$; and wherein the paper product has improved strength compared to a comparable paper product having nanocellulose without the crosslinking compound, with less than a 15% loss of freeness compared to the enhanced market pulp.

13. The method of claim 12, wherein the crosslinking compound is selected from the group consisting of aldehydes, resins, carbonates, and isocyanates.

14. The method of claim 13, wherein the crosslinking compound is a dialdehyde.

15. The method of claim 12, wherein the step of removing water from the composite-enhanced market pulp comprises drying the pulp to remove from about 80 wt % to about 95 wt % of water.

* * * * *